US010179992B2

(12) United States Patent
Brekke

(10) Patent No.: US 10,179,992 B2
(45) Date of Patent: Jan. 15, 2019

(54) HEAVY DUTY HANGER FOR FIRE SEPARATION WALL

(71) Applicant: Columbia Insurance Company, Omaha, NE (US)

(72) Inventor: Steven Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 15/230,926

(22) Filed: Aug. 8, 2016

(65) Prior Publication Data

US 2018/0038094 A1 Feb. 8, 2018

(51) Int. Cl.
*E04B 1/26* (2006.01)
*B21D 53/36* (2006.01)
*E04B 1/94* (2006.01)

(52) U.S. Cl.
CPC ..... *E04B 1/2612* (2013.01); *B21D 53/36* (2013.01); *E04B 1/945* (2013.01); *E04B 2001/2644* (2013.01); *E04B 2001/2652* (2013.01); *E04B 2001/2676* (2013.01)

(58) Field of Classification Search
CPC ..... B21D 53/56; E04B 1/2612; E04B 2001/2644; E04B 2001/2652; E04B 2001/2676; E04B 1/945
See application file for complete search history.

(56) References Cited

U.S. PATENT DOCUMENTS 414,169 A 10/1889 Reuschel
478,163 A 7/1892 Lehman
537,504 A 4/1895 Van Dorn
546,147 A 9/1895 Gregg
598,135 A 2/1898 Butz
625,427 A 5/1899 Stewart, Jr.
666,918 A 1/1901 Butz
717,316 A 12/1902 Avery
753,053 A 2/1904 Eberhardt
770,050 A 9/1904 Dreyer
(Continued)

FOREIGN PATENT DOCUMENTS

WO 2012060863 A2 5/2012
WO 2013126987 A1 9/2013

OTHER PUBLICATIONS

Installer's Pocket Guide, Simpson Strong-Tie Company Inc. (2009), 60 pages.

(Continued)

*Primary Examiner* — James M Ference
(74) *Attorney, Agent, or Firm* — Stinson Leonard Street LLP

(57) ABSTRACT

A hanger for connecting a structural component to a wall having sheathing mounted thereon after the hanger is connected to the wall. The hanger includes a channel-shaped portion configured to receive a structural component. An extension portion extends from the channel-shaped portion and is configured to extend through the sheathing. A connection portion extends from the extension portion and is configured for attachment to the wall. The connection portion includes connector flanges configured to attach to a stud of the wall. The extension portion minimally disrupts the continuity of the sheathing to maintain the fire resistive rating of the sheathing.

20 Claims, 10 Drawing Sheets

(56) References Cited

U.S. PATENT DOCUMENTS

| | | | | | |
|---|---|---|---|---|---|
| 796,433 | A | | 8/1905 | Kahn | |
| 804,451 | A | | 11/1905 | Carlson | |
| 783,807 | A | | 2/1906 | Tuteur | |
| 828,488 | A | * | 8/1906 | Lanz | B21D 53/00 29/897.3 |
| 874,514 | A | | 12/1907 | Lindow | |
| 922,215 | A | | 5/1909 | Tuteur | |
| 924,842 | A | | 6/1909 | Seipp | |
| 943,847 | A | | 12/1909 | Seipp | |
| 1,406,723 | A | | 2/1922 | Caldwell | |
| 1,728,981 | A | * | 9/1929 | Ropp | E04B 1/2612 52/702 |
| 3,125,785 | A | * | 3/1964 | Conville | E04B 2/80 52/238.1 |
| 3,907,445 | A | * | 9/1975 | Wendt | E04B 1/2612 403/191 |
| 3,945,741 | A | * | 3/1976 | Wendt | E04B 1/5818 403/191 |
| 3,972,169 | A | * | 8/1976 | Sheppard, Jr. | E04B 1/2608 248/300 |
| 4,005,942 | A | * | 2/1977 | Gilb | E04B 1/2612 248/903 |
| 4,198,175 | A | | 4/1980 | Knepp et al. | |
| 4,223,866 | A | | 9/1980 | Black | |
| 4,230,416 | A | * | 10/1980 | Gilb | E04B 1/2612 248/300 |
| 4,261,155 | A | * | 4/1981 | Gilb | E04B 1/2612 248/282.1 |
| 4,353,664 | A | * | 10/1982 | Gilb | E04B 1/2612 403/232.1 |
| 4,411,548 | A | * | 10/1983 | Tschan | E04B 1/2612 403/232.1 |
| 4,422,792 | A | * | 12/1983 | Gilb | E04B 1/2612 403/232.1 |
| 4,472,916 | A | | 9/1984 | Krebs | |
| 4,560,301 | A | * | 12/1985 | Gilb | B21D 53/38 403/232.1 |
| 4,584,813 | A | | 4/1986 | Hudson | |
| 4,594,017 | A | | 6/1986 | Hills | |
| 4,665,672 | A | | 5/1987 | Commins et al. | |
| 4,920,725 | A | | 5/1990 | Gore | |
| 5,104,252 | A | * | 4/1992 | Colonias | E04B 1/2612 403/230 |
| 5,111,632 | A | * | 5/1992 | Turner | E04B 1/2612 403/232.1 |
| 5,160,211 | A | | 11/1992 | Gilb | |
| 5,230,198 | A | | 7/1993 | Callies | |
| 5,249,404 | A | | 10/1993 | Leek et al. | |
| 5,341,619 | A | * | 8/1994 | Dunagan | E04B 1/2612 248/300 |
| 5,457,928 | A | * | 10/1995 | Sahnazarian | E04B 1/2612 403/232.1 |
| 5,555,694 | A | * | 9/1996 | Commins | E04B 1/2612 248/300 |
| 5,564,248 | A | * | 10/1996 | Callies | E04B 1/2612 403/232.1 |
| 5,603,580 | A | | 2/1997 | Leek et al. | |
| 5,797,694 | A | * | 8/1998 | Breivik | E04B 1/2608 403/231 |
| 5,896,721 | A | | 4/1999 | Sugiyama | |
| 6,131,358 | A | * | 10/2000 | Wise | E04B 1/2612 52/289 |
| 6,230,466 | B1 | * | 5/2001 | Pryor | E04B 1/2612 403/231 |
| 6,463,711 | B1 | * | 10/2002 | Callies | E04B 1/2612 403/232.1 |
| 6,877,291 | B2 | * | 4/2005 | Shamroukh | E04B 7/022 403/232.1 |
| 7,316,098 | B1 | * | 1/2008 | Sackett | E04B 7/045 52/712 |
| 7,707,785 | B2 | | 5/2010 | Lin | |
| 7,971,410 | B2 | | 7/2011 | Jerke | |
| 8,387,333 | B2 | * | 3/2013 | Brekke | E04B 1/2612 403/232.1 |
| 8,677,718 | B2 | * | 3/2014 | Marshall | E04D 3/3608 52/655.1 |
| 8,720,155 | B1 | * | 5/2014 | Robell | E04B 1/2612 52/289 |
| 9,206,594 | B1 | * | 12/2015 | Grevious | F16B 5/0614 |
| 2002/0078656 | A1 | * | 6/2002 | Leek | E04B 1/2612 52/702 |
| 2004/0096269 | A1 | | 5/2004 | Shahnazarian | |
| 2004/0129845 | A1 | * | 7/2004 | Whale | E04B 1/2612 248/201 |
| 2005/0120669 | A1 | * | 6/2005 | Harrison | E04B 1/2612 52/698 |
| 2006/0081743 | A1 | * | 4/2006 | Evans | E04B 1/2612 248/226.11 |
| 2006/0156682 | A1 | * | 7/2006 | McAndrew | E04B 1/2612 52/837 |
| 2006/0191233 | A1 | * | 8/2006 | Tamlyn | E04B 1/2612 52/702 |
| 2007/0119108 | A1 | | 5/2007 | Downard | |
| 2007/0294979 | A1 | * | 12/2007 | Lin | E04B 1/2612 52/702 |
| 2008/0101855 | A1 | * | 5/2008 | Lin | E04B 1/2612 403/232.1 |
| 2008/0237421 | A1 | * | 10/2008 | Szpotowski | E04B 1/2612 248/222.51 |
| 2009/0113839 | A1 | * | 5/2009 | Carr | E04B 1/2612 52/712 |
| 2010/0031601 | A1 | * | 2/2010 | Lin | E04B 1/2612 52/712 |
| 2011/0146173 | A1 | * | 6/2011 | Visser | E04B 1/26 52/268 |
| 2012/0222382 | A1 | | 9/2012 | Brekke | |
| 2012/0297724 | A1 | * | 11/2012 | Pope | E04B 1/2604 52/702 |
| 2013/0067850 | A1 | * | 3/2013 | Sasanecki | E04B 1/2612 52/702 |
| 2014/0338282 | A1 | * | 11/2014 | Sidhu | E04C 3/04 52/702 |
| 2015/0167291 | A1 | * | 6/2015 | Bundy | E04B 1/2612 52/702 |
| 2015/0184370 | A1 | * | 7/2015 | Brekke | E04B 1/2612 52/708 |
| 2015/0218832 | A1 | * | 8/2015 | Peters | E04B 5/12 269/46 |
| 2017/0321418 | A1 | | 11/2017 | Tremblay | |

OTHER PUBLICATIONS

Top-Flange Joist Hangers Installed on Walls Over Wood Structural Panel Sheathing or Drywall, Technical Bulletin, Simpson Strong-Tie Company, Inc. (2013), 2 pages.

S/LBV / S/B and S/BA Hangers, Simpson Strong-Tie Company Inc. (2010), 1 page.

Cold-Formed Steel Connectors for Residential and Mid-Rise Construction (C-CFS10), Simpson Strong-Tie Company Inc. (2010), 76 pages.

Wood Construction Connectors Catalog 2013-2014 (C-2013), Simpson Strong-Tie Company Inc., 236 pages.

Final Office action dated Jan. 17, 2018, U.S. Appl. No. 14/555,049, 13 pages.

* cited by examiner

HEAVY DUTY HANGER FOR FIRE SEPARATION WALL

FIELD OF THE INVENTION

The present invention generally relates to connections for structures, and more specifically, a hanger for connecting a joist or truss to the studs and top plates of a wall including fire retardant sheathing.

BACKGROUND

The use of fire separation walls in structures, such as a multifamily housing, is commonplace. Often, fire separation is required to be continuous along the walls between adjoining units to prevent fire from spreading between the adjoining units in a multifamily structure. For some types of construction, the building codes also require exterior walls to be fire rated. Typically, gypsum board is used a fire retardant sheathing along these walls. Floor trusses or joists are attached to or hung from the walls including the gypsum board, but cannot be hung from the gypsum board itself. The trusses or joists must therefore be attached to the wall framing, often with a type of hanger. However, a cutout for the entire cross section of the truss leaves a large discontinuity in the fire retardant sheathing. Building codes require the fire separation wall maintain a certain fire resistant rating. The fire resistant rating of the sheathing can be reduced by a large opening in the sheathing allowing a truss to pass through. Thus, interruptions of the fire retardant sheathing need to be kept to a minimum in order to maintain the integrity of the sheathing's fire resistance. In a prior design, shown in co-assigned U.S. Publication No. 2015/0184370, a hanger was able to be mounted on a wall through a narrow slit in the gypsum board. Hangers for heavier truss loads must be able to support the increased weight while preventing the gypsum board from being damaged

SUMMARY

In one aspect, a hanger for connecting a structural component to a wall including a top plate and studs extending down from the top plate, the wall being adapted to have sheathing mounted thereon, generally comprises a channel-shaped portion configured to receive the structural component. An extension portion extends from the channel-shaped portion and is configured to extend through the sheathing to engage the wall at a first location. A connection portion is configured for attachment to one of the studs at a second location spaced from the first location. The connection portion includes a connection flange arranged with respect to the extension portion to overlie and engage a side portion of said one stud.

In another aspect, a method of making a hanger for connecting a structural component to a wall including a top plate and studs extending down from the top plate generally comprises providing a sheet of material, stamping a blank from the sheet of material, and bending the blank to form a hanger. The hanger comprises a channel-shaped portion configured to receive the structural component. An extension portion extends from the channel-shaped portion and is configured to extend through sheathing to engage the wall at a first location. A connection portion is configured for attachment to one of the studs at a second location spaced from the first location. The connection portion includes a connection flange arranged with respect to the extension portion to overlie and engage a side portion of said one stud.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
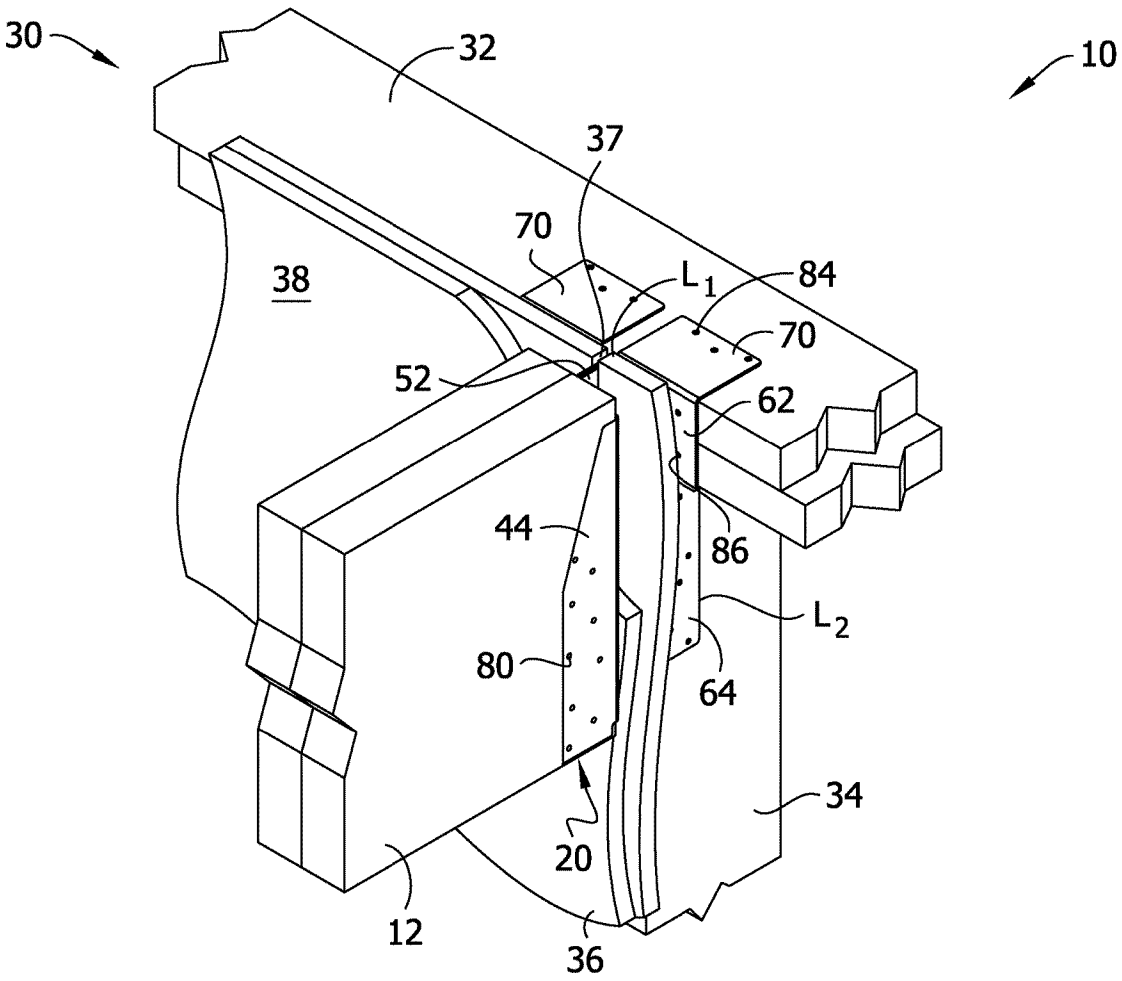
FIG. 1 is a front, fragmentary perspective of a joist and wall connection through fire retardant sheathing using a hanger.
Figure 2:
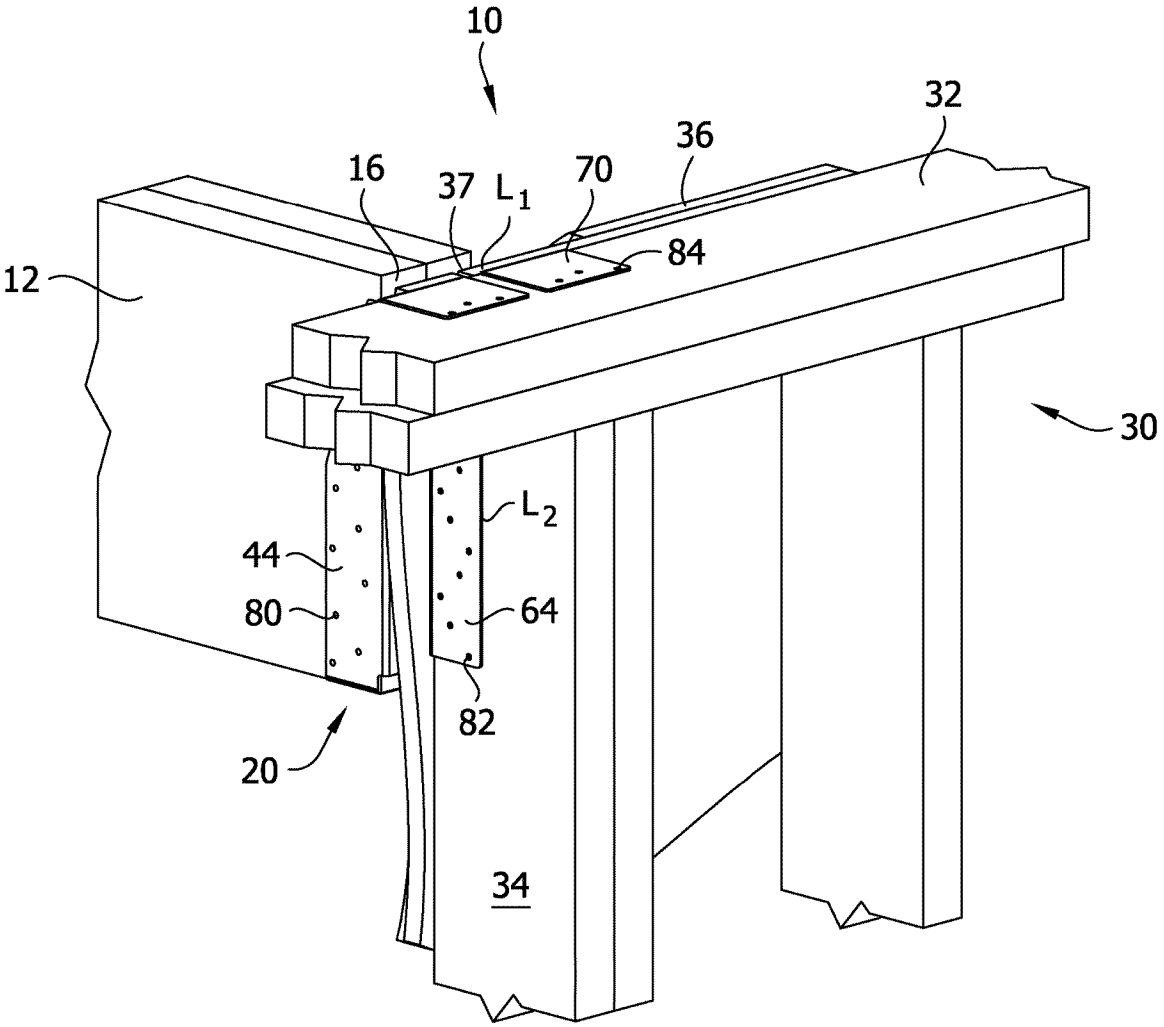
FIG. 2 is a rear perspective of the joist and wall connection of FIG. 1.
Figure 3:
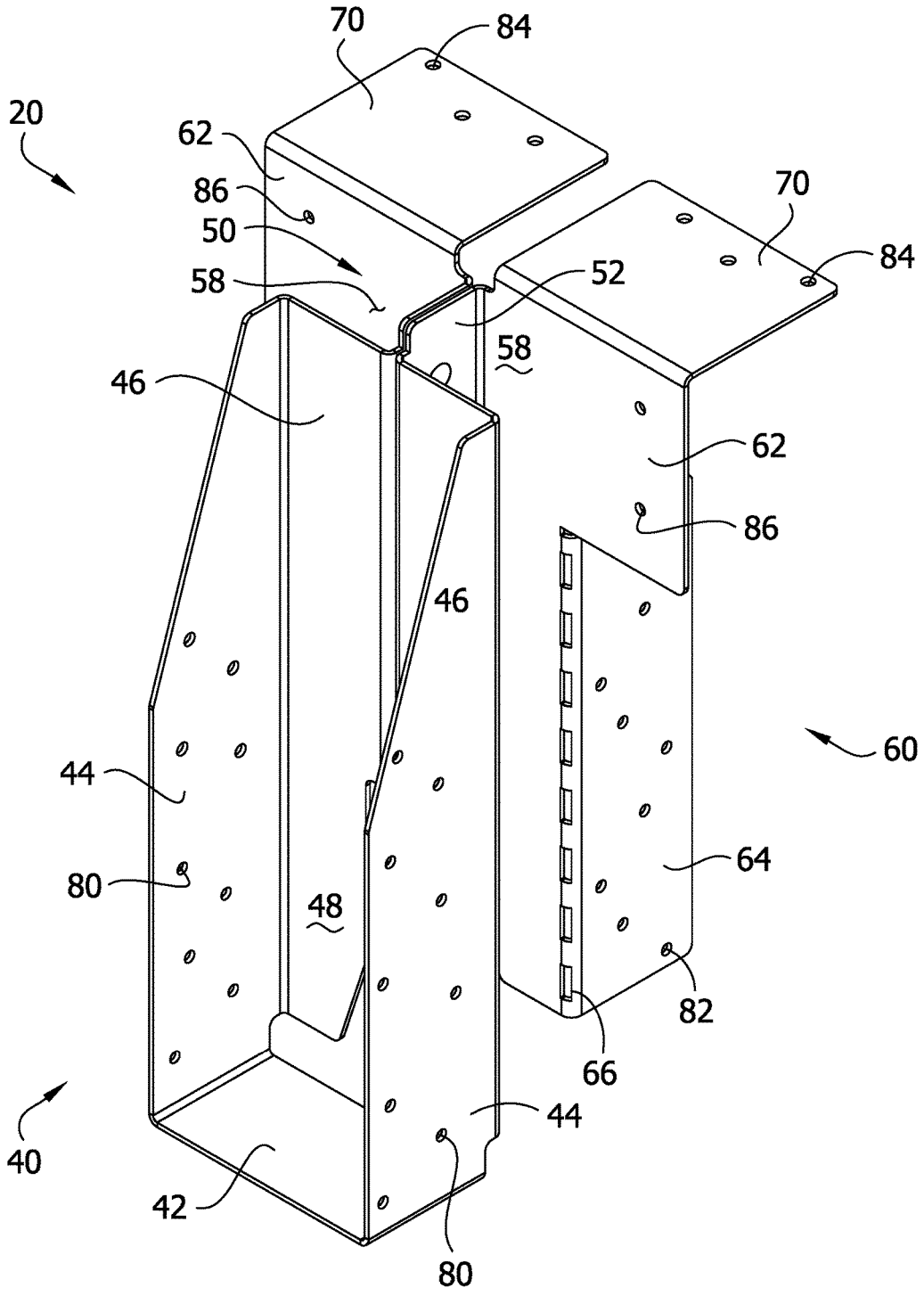
FIG. 3 is a front perspective of the hanger.
Figure 4:
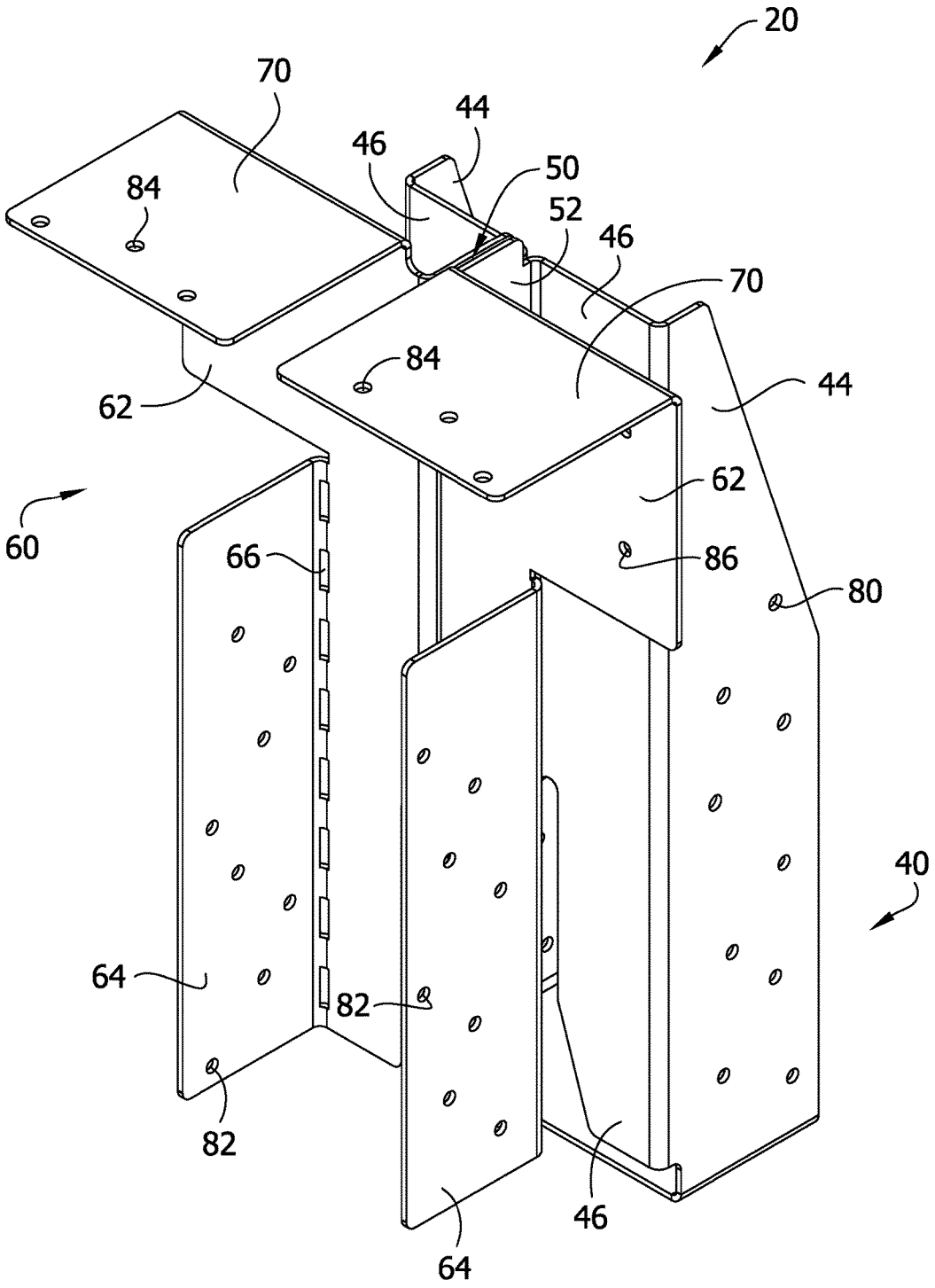
FIG. 4 is a rear perspective thereof.
Figure 5:
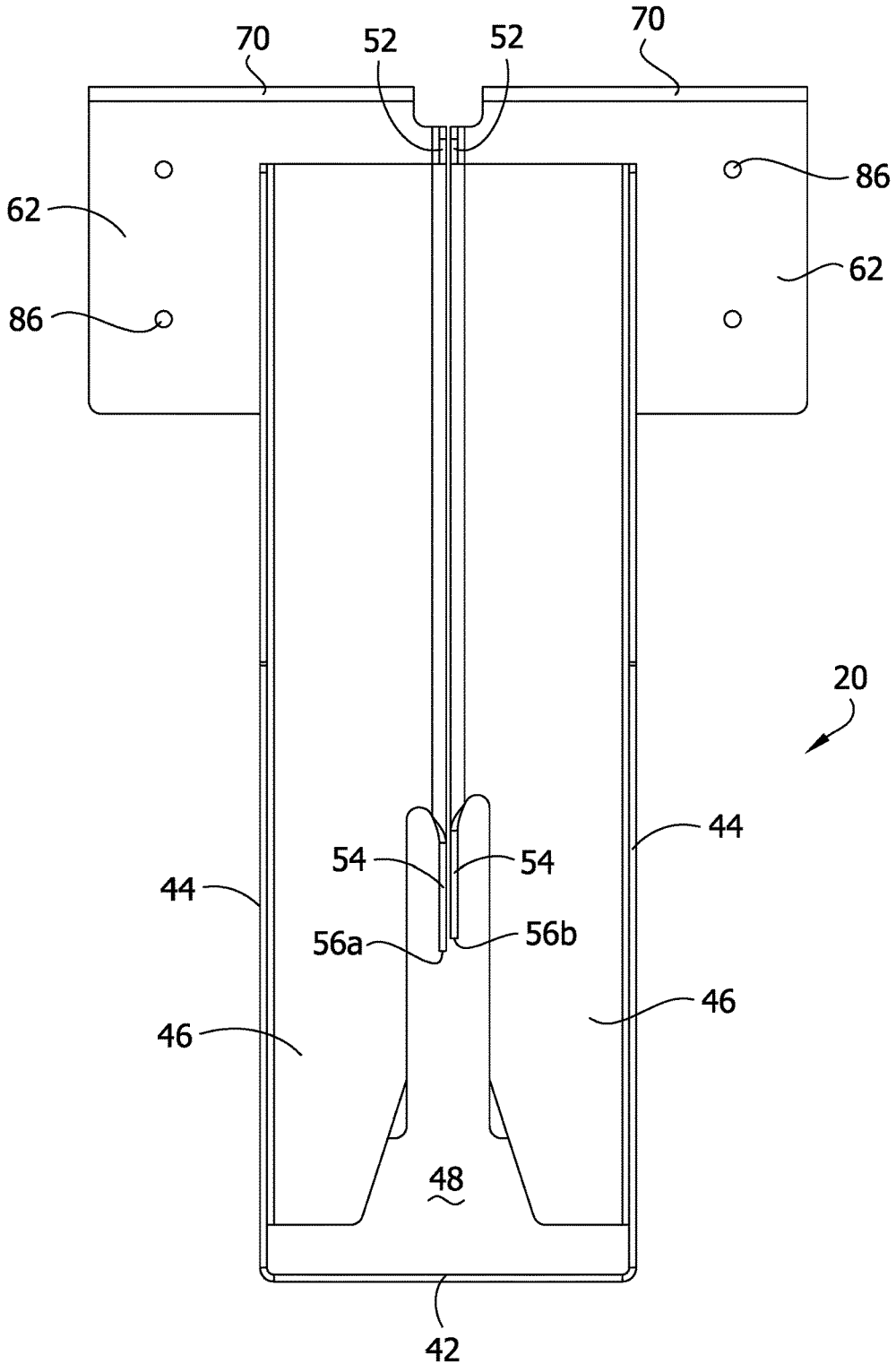
FIG. 5 is a front elevation thereof.

Referring to FIGS. 1 and 2, an example embodiment of a connection system for a fire separation wall is shown generally at 10. A joist generally indicated at 12 is connected to a wall 30 with a hanger 20. The joist 12 can be solid sawn (as shown), structural composite lumber, or multi-ply truss wood framing. As shown, the joist 12 is formed by two 2×10's in side-by-side relation. The type and size of joist 12 may vary from the illustrated embodiment without departing from the scope of the invention, as a hanger 20 according to the present invention is readily applicable to other joist configurations (e.g. a larger or smaller joist). Moreover, the hanger 20 may be used to connect structural components other than joists to the stud of a wall or other part of a structure.

As seen in FIG. 1, a wall 30 includes vertical support members or studs 34 (only one stud may be seen in FIG. 1) and generally includes a top member or plate 32. As illustrated, the top plate 32 is formed by 2×6's in stacked relation. Fire retardant sheathing 36 is mounted on the face of the wall 30. In one embodiment, the fire retardant sheathing is gypsum board, such as two layers of ⅝" gypsum board mounted on the face of the wall 30 as illustrated, although other configurations of fire retardant sheathing are within the scope of the present invention. Other wall configurations, including different wall constructions and materials, are within the scope of the present invention. For example, the hanger 20 can be used with any wall assembly or fire-rated wall assembly having studs, such as a 2-hour or 1-hour fire-resistive wall assembly. The joist 12 is mounted on the wall 30 adjacent to the fire retardant sheathing 36 by the hanger 20. The hanger 20 extends through a narrow slot in the fire retardant sheathing 36 to maintain the integrity and fire retardant characteristics of the fire separation wall.

Referring to FIGS. 3-8, the hanger 20 includes a channel-shaped portion 40, an extension portion 50, and a connection portion 60. The channel-shaped portion 40 is configured to receive the joist 12. The channel-shaped portion 40 includes a seat or base 42 and a pair of side panels 44 extending upward from the base 42. When installed, the base 42 is generally horizontal, and the side panels 44 extend generally vertical from the base 42. A back panel 46 extends from each of the side panels 44. Each back panel 46 is generally perpendicular to both side panels 44 and the base 42. When installed, each back panel 46 extends generally parallel to an interior face 38 of the fire retardant sheathing 36. The base 42, side panels 44, and back panels 46 form a channel 48 configured to receive the joist 12.

Referring again to FIGS. 1-3, the joist 12 is received in the channel 48 of the hanger 20 to attach the joist 12 to the wall 30. The bottom face 14 of the joist 12 engages and rests upon (i.e. is supported by) the base 42. The end face 16 of the joist 12 is positioned near the back panels 46 and between the side panels 44. The hanger 20 includes fastening structure for attaching the joist 12 to the hanger 20. The fastening structure can be of any type known in the art for attaching a connector to a wooden structural member, such as nailing teeth (not shown) struck from the material of the hanger. In the illustrated embodiment, the fastening structure comprises one or more holes to allow for the insertion of fastening members. More specifically, in one embodiment the fastening structure comprises nail holes 80 in the side panels 44 of the hanger 20, and the fastening member comprises a nail (not shown). Other fastening members are within the scope of the present invention. For example, the fastening member can be a screw. In the illustrated embodiment, nail holes 80 are positioned on each of the side panels 44 so nails (not shown) can be inserted into both the sides of the joist 12 to attach the hanger 20 to the joist 12.

Figure 6:
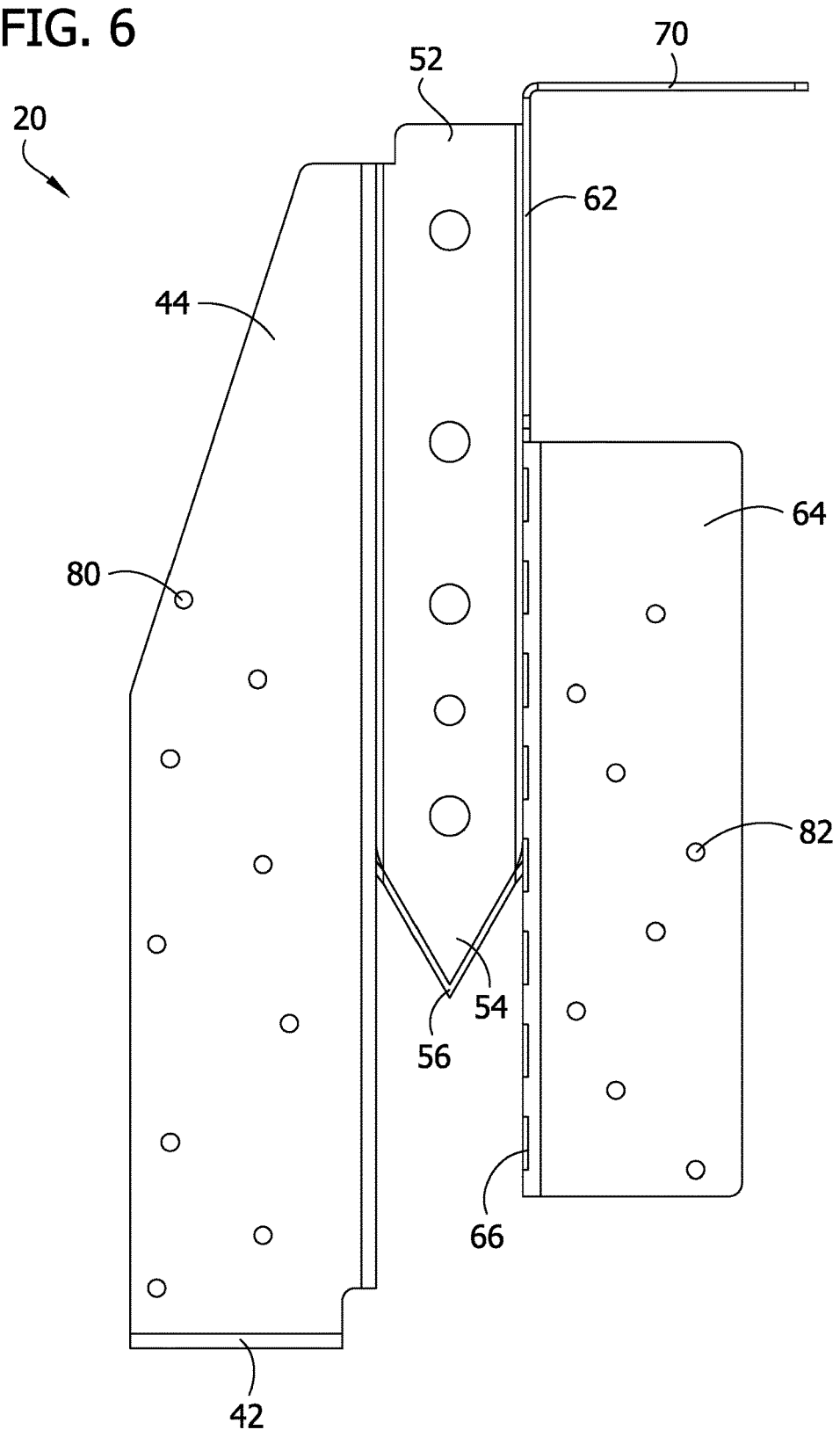
FIG. 6 is a right side elevation thereof.
Figure 7:
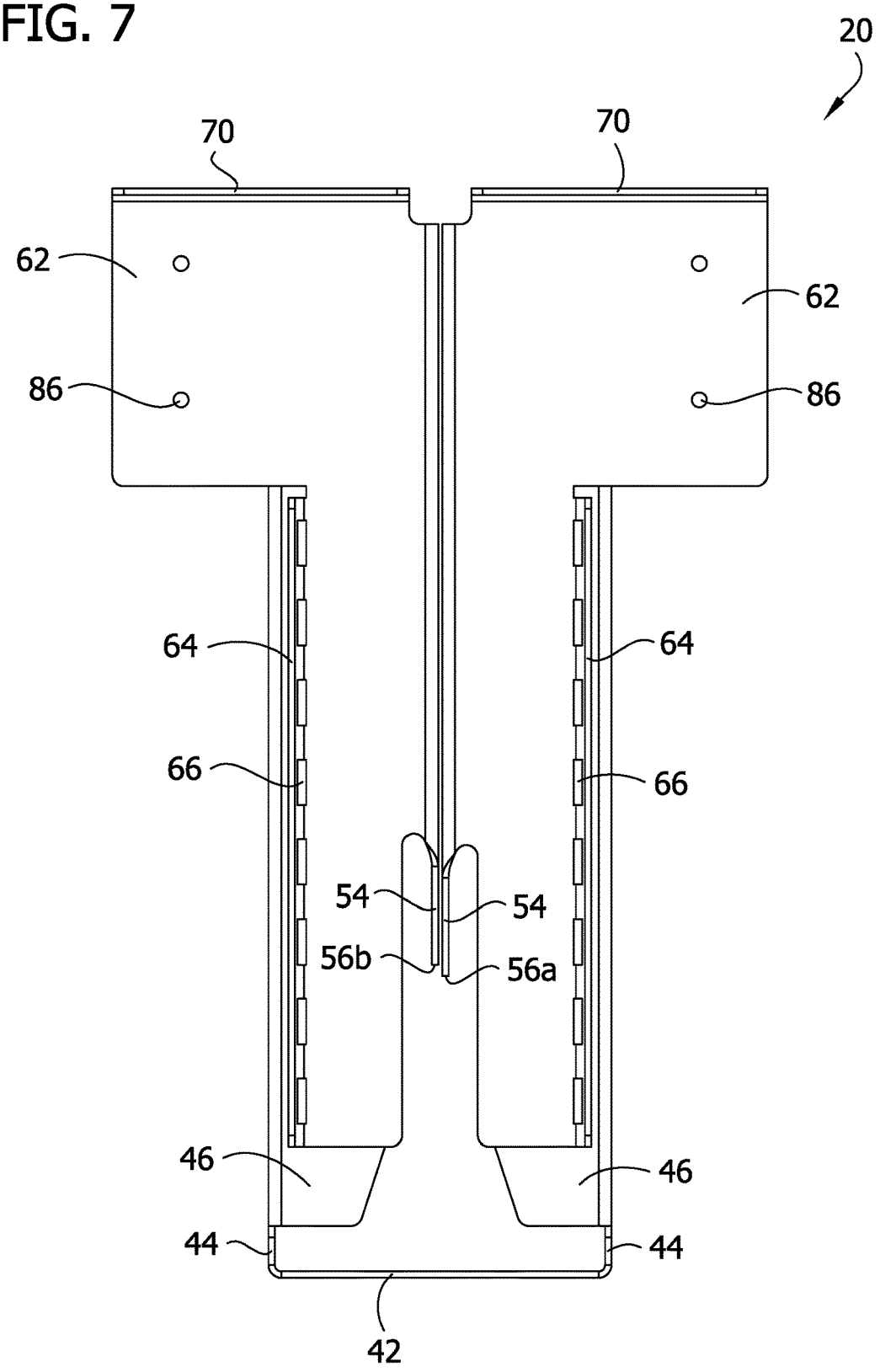
FIG. 7 is a rear elevation thereof.
Figure 8:
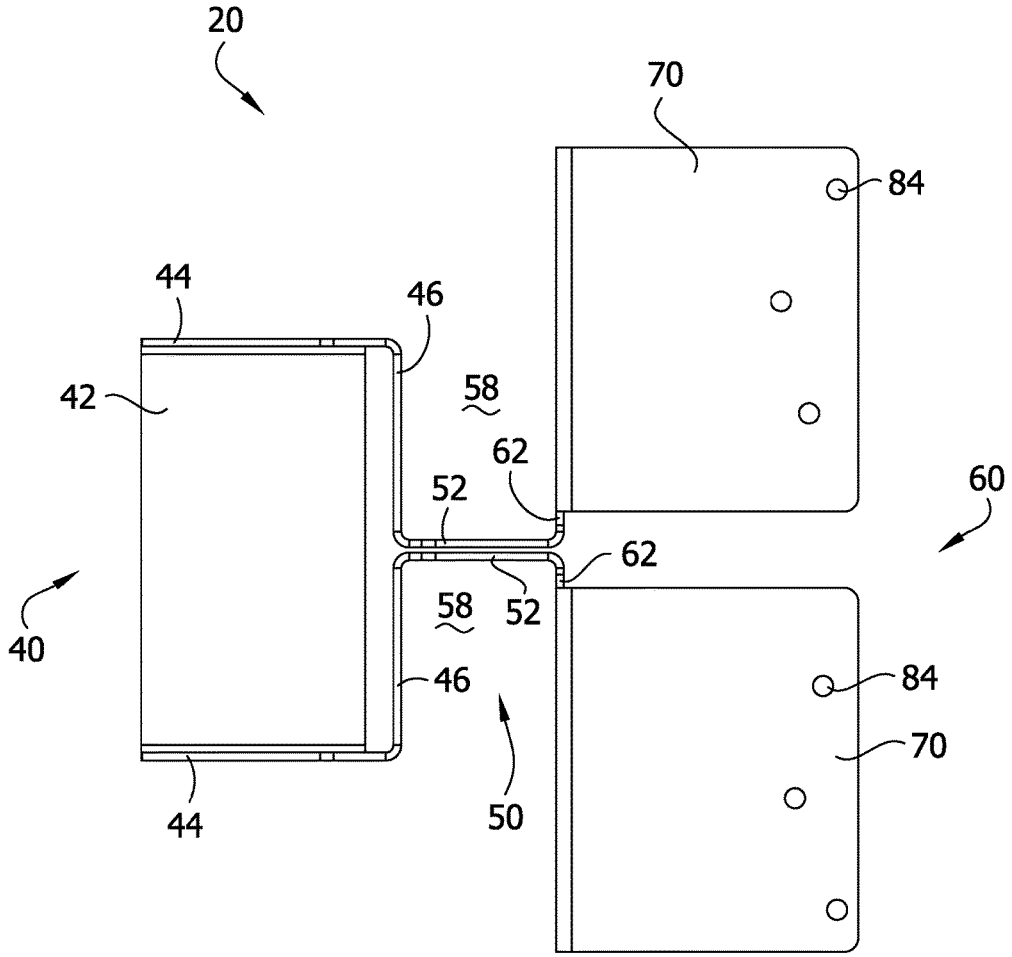
FIG. 8 is a top plan thereof.

Referring again to FIGS. 3-8, the extension portion 50 includes two extension flanges 52 configured to extend through the fire retardant sheathing 36. Each extension flange 52 extends from one of the back panels 46. The extension flanges 52 are positioned in opposed, face-to-face relation, and preferably engage each other along a juncture. Each extension flange 52 extends generally perpendicular from the corresponding back panel 46 and generally parallel to the side panels 44. Each extension flange 52 includes a driving point 54 at the bottom edge, the use of which will be explained hereinafter. Each of the driving points 54 is generally triangular and includes a pointed tip 56. As seen in FIGS. 6 and 7, the tips 56 of the driving points 54 are vertically offset from each other. As illustrated in FIG. 7, the tip 56*a* of one extension flange 52 extends vertically below the tip 56*b* of the other extension flange 52. In one embodiment, the tips 56 are vertically offset from each other about ⅛", although other configurations are within the scope of the present invention, such as tips aligned or tips offset a smaller or larger amount.

A back flange 62 extends from each extension flange 52. Each back flange 62 extends generally perpendicular from the extension flange 52 and is oriented generally parallel to the back panels 46. Referring to FIG. 1, the back flanges 62 engage the wall 30 at a first location $L_1$, which in the illustrated embodiment is a vertical face of the top plate 32 and a vertical face of the stud 34. Other configurations are within the scope of the present invention, such as the back flanges 62 only engaging the vertical face of the stud 34 at a first location $L_1$. Each back flange 62 may include a fastening structure, such as nail holes 86, for insertion of a fastening member, such as nails (not shown), to attach the hanger 20 to the wall 30. In the illustrated embodiment, each back flange 62 includes two nail holes 86. Other configurations are within the scope of the present invention, such as a different number of nail holes, or alternate fastening structure such as nailing teeth or other appropriate structure for fastening the hanger to the wall (e.g. screw or bolt). As seen in FIG. 1, the fastening structure, nail holes 86, on the back flange 62 is configured to align with the top plate 32 of the wall. In this orientation, a fastener, such as a nail (not shown), driven through the nail holes 86 attaches the hanger 20 to the top plate 32 of the wall 30. Other configurations are within the scope of the present invention, such as configuring the nail holes 86 to align with the stud 34, thereby attaching the back flange to the stud 34 when a fastener is driven through the nail holes. The back panels 46, extension flanges 52, and back flanges 62 form a pair of sheathing channels 58 (see, FIG. 8). Each sheathing channel 58 is configured to receive a portion of the fire retardant sheathing 36 to secure the sheathing between the hanger 20 and the wall 30.

As seen in FIG. 1, the extension flanges 52 extend through a slot 37 in the fire retardant sheathing 36. Preferably, the slot has an area less than or equal to 6 square inches, and the gap between the extension flanges 52 and the edge of the slot 37 is less than or equal to ⅛". The slot 37 can be any suitable length and in one embodiment is about 9 inches long. The driving points 54 extend down into the sheathing 36 to further secure the sheathing between the hanger 20 and the wall 30. A portion of the fire retardant sheathing 36 extends into each sheathing channel 58 and is secured between the back panel 46 and the back flanges 62.

The slot 37 in the fire retardant sheathing 36 can be formed using a cutting tool (e.g. a drywall cutout tool). A guide or template (not shown) can be used to help position the cutting tool (not shown). Other cutting tools may be used to form the slot 37 in the fire retardant sheathing 36 and are within the scope of the present invention. After the slot 37 is formed, the sheathing 36 is then configured to receive the hanger 20.

Referring again to FIGS. 3-8, the connection portion 60 of the hanger 20 includes a pair of connection flanges 64 extending from the back flanges 62. Each connection flange 64 extends generally perpendicular from one of the back flanges 62. The connection flanges 64 are generally vertical when the hanger 20 is installed. As illustrated in FIG. 1, the connection flanges 64 are configured to overlie and engage a generally vertical, side surface of the stud 34 of the wall 30 at a second location $L_2$ spaced from the first location $L_1$. The connection flange 64 is used to attach the hanger 20 to the studs 34 of the wall 30, thereby hanging the joist 12 from the studs 34. As seen in FIG. 1, the connection flange 64 extends over a portion of the stud 34 of the wall 30. Each connection flange 64 includes a fastening structure, such as nail holes 82, for insertion of a fastening member, such as nails (not shown), to attach the hanger 20 to the stud 34. In the illustrated embodiment, each connector flange includes eight nail holes 82. Other configurations are within the scope of the present invention, such as a different number of nail holes or alternate fastening structure such as nailing teeth or other appropriate structure for fastening the hanger to the wall.

Referring to FIGS. 1-10, the connection portion 60 of the hanger 20 includes a pair of connector tabs 70 extending from the back flanges 62. Each connector tab 70 extends generally perpendicular from one of the back flanges 62. The connector tabs 70 are generally horizontal when the hanger 20 is installed. The connector tabs 70 are configured to engage an upper surface of the top plate 32 of the wall 30. The connector tabs 70 can be attached to the top plate 32 of the wall 30, thereby providing additional support to the hanger 20. Although FIGS. 1-10 show the connector tabs 70, configurations without connector tabs 70 are within the scope of the present invention.

As seen in FIG. 1, the connector tabs 70 extend over a portion of the top plate 32 of the wall 30. Each connector tab 70 includes a fastening structure, such as nail holes 84, for driving a fastening member, such as nails (not shown), through the connector tab 70 and into the top plate 32. In the illustrated embodiment, each connector tab 70 includes three nail holes 84. Other configurations are within the scope of the present invention, such as a different number of nails holes, or alternate fastening structure such as nailing teeth or other appropriate structure for fastening the hanger to the wall (e.g. a screw or bolt).

The back flanges 62, connection flanges 64 and connector tabs 70 of the hanger 20 cooperate to stabilize the hanger 20 and protect the fire retardant sheathing 36 from the loads transferred from the joist 12 to the wall 30 by way of the hanger 20. The channel 48 that receives an end portion of the joist 12 is spaced from the wall 30 and more particularly spaced from the second location $L_2$ where the connection flanges 64 are attached to the side surface of the stud 34. The vertically downward load of the joist 12 applied to the base 42 of the hanger 20, is resisted by the connector tabs 70. The back flanges 62 and connection flanges 64, as nailed into the top plate 32 and stud 34. However, the hanger 20 is also urged by the load to pivot on the connector tabs 70 so that the base 42 would move toward the wall 30, which could puncture and damage the fire retardant sheathing 36. The pivoting motion is resisted by the nails connecting the connector tabs to the top plate 32, but tends to pry the nails out of the top plate. This pivoting motion is beneficially also resisted by (1) the engagement of the back flanges 62 with the vertical face of the stud 34 at the first location $L_1$ and (2) the engagement of the connection flanges 64 with the side surface of the stud 34 at the second location $L_2$. The connection flanges 64 are positively connected to the stud 34 and resist the movement of the hanger 20 by resisting movement in or deformation of the back flanges 62. The positive connection of the connection flanges 64 to the stud 34 allows the hanger to resist pivoting even if there is a space between the back flanges 62 and the top plate 32 and/or the stud 34. The connection flanges 64 also stiffen the back flanges 62. Accordingly, the use of connection flanges 64 increases the load the hanger 20 can accept from the joist 12. The force applied to the base 42 and back panels 46 of the hanger 20 by the vertical load of the joist 12, urging the hanger 20 to pivot, is resisted by the back flanges 62 and connection flanges 64 engaging the stud 34. Therefore, the hanger 20 and joist 12 are stable with minimal disruption of the fire retardant sheathing 36, even though the truss is held at a distance from the wall 30 by the hanger 20.

Figure 10:
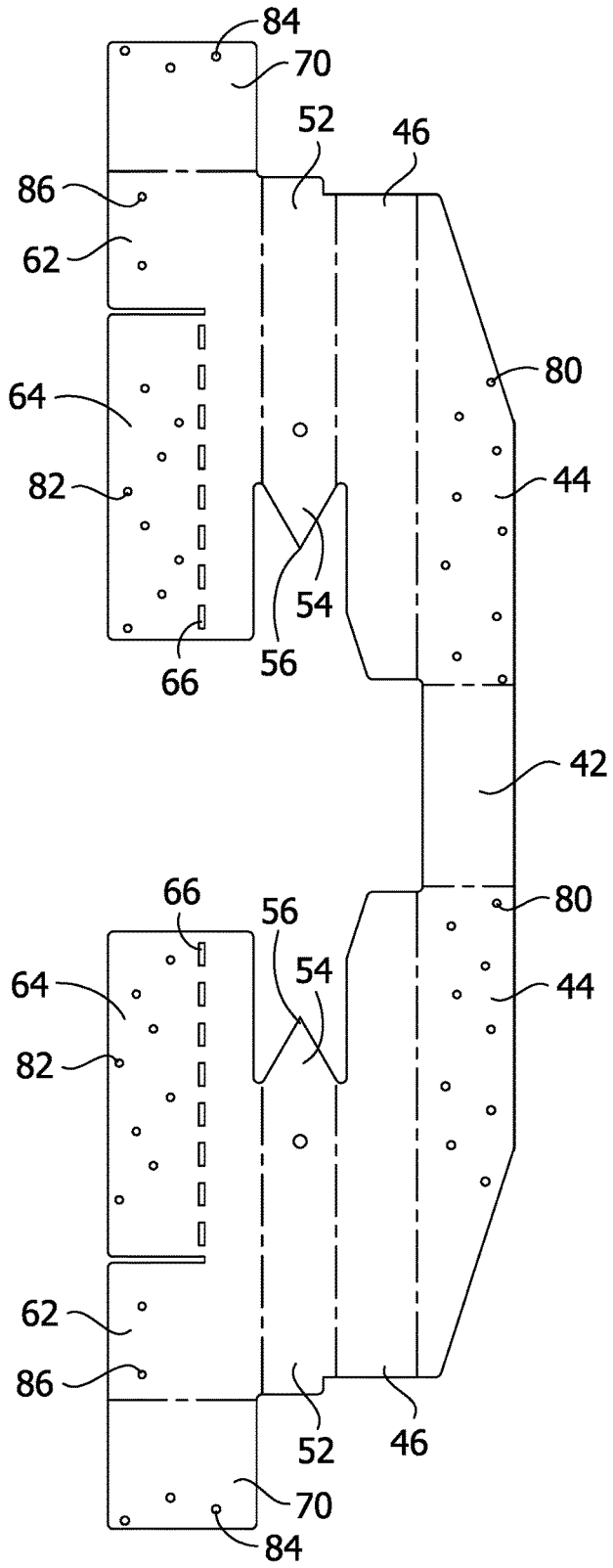
FIG. 10 is a top view of a stamped metal blank for forming a hanger according to the present invention.

As seen in FIG. 10, the hanger 20 can be formed as one piece from a metal blank 90 that is stamped from a sheet metal roll and bent into shape. The bends are indicated by broken lines in FIG. 10. The metal blank 90 can include perforations 66 between the connection flange 64 and back flange 62 to facilitate the bending of the connection flange 64 in relation to the back flange 62. The perforations 66 reduce the force required to bend the connection flange 64 with respect to the back flange 62, allowing for easier manual bending and adjustments in the field. For example, the connection flanges 64 may be bent so that they are in close fitting relationship with the particular stud 34 in the field. That helps to facilitate a final connection of the connection flange 64 to the stud 34 which is tight and secure. In one embodiment, the hanger 20 is stamped from 12-14 gauge steel, although other suitable materials are within the scope of the present invention. The configuration of the hanger 20 of the present invention allows a lighter gauge metal to be used.

Figure 9:
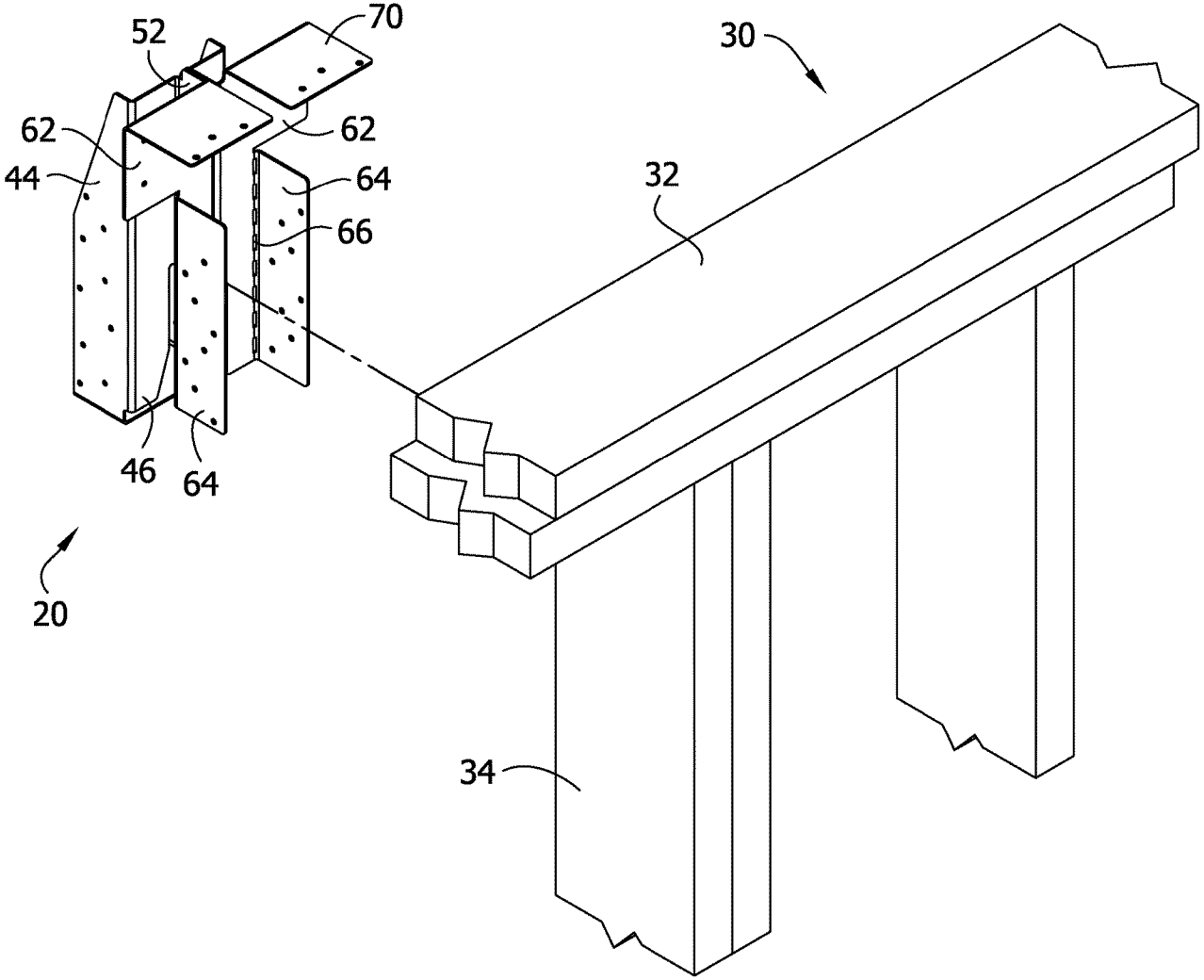
FIG. 9 is a rear exploded perspective of the hanger and a stud wall with top plates.

In use, the hanger 20 is installed on the wall 30 before the sheathing 36 is mounted on the wall (see FIG. 9). This simplifies construction by allowing the building to be completely framed and roofed before requiring the sheathing 36 to be installed. Trade workers (e.g. mechanical, electrical, etc.) therefore have complete access to the wall cavity to install components without interference from the sheathing 36. The hanger 20 is positioned at the desired height against the stud 34 of the wall 30 such that the back flanges 62 engage the face of the stud 34 and the connection flanges 64 engage the side surface of the stud 34. The connection flanges 64 are fastened to the side surface of the stud 34 of the wall 30 by driving nails (not shown) through nail holes 82. The back flanges 62 are fastened to the top plate 32 or the stud 34 of the wall 30, depending on the configuration of the nail holes 86 by driving nails (not shown) through the nail holes 86. The connector tabs 70 are fastened to the top plate 32 by any suitable means by driving nails (not shown) through nail holes 84. Then, one end of a joist 12 is positioned in the channel 48 of the hanger 20. The hanger 20 is fastened to the joist 12 by driving nails (not shown) through the nail holes 80 in each side panel 44 of the hanger 20. The joist 12 is thereby secured to the hanger 20 and the wall 30, and access to the wall cavity remains unhindered by sheathing. Subsequently, the sheathing 36 can be mounted on the wall 30 by moving the sheathing upward into place so the extension flanges 52 of the hanger 20 extend through the slot 37 of the sheathing 36 and the sheathing 36 is positioned in the sheathing channels 58 between the back flanges 62 and the back panels 46. The driving point 54 of each extension flange 52 helps guide the sheathing 36 into place and may also be used to mark the slot 37 location on the sheathing 36 prior to mounting the sheathing 26 on the wall 30.

The hanger 20 permits a joist 12 to be secured to a wall 30 through fire retardant sheathing 36 with minimal interruption to the sheathing 36 by the slot 37. Installation of the hanger 20 minimally disrupts the continuity of the sheathing 36 and therefore does not reduce the fire resistive rating of the fire rated assembly. The extension flanges 52 extend through the fire retardant sheathing 36 so the sheathing 36 is interrupted only by the slot 37 required to receive the extension flanges 52. The connection flanges 64 engage the side surface of the stud 34, the back flanges 62 engage the wall 30 behind the sheathing 36, and the connector tabs 70 extend over a portion of the top plate 32 to stabilize the hanger 20 and protect the sheathing 36. The hanger 20 is mounted on a wall 30 before the sheathing 36 (i.e., the sheathing 36 does not have to be mounted on the wall 30 before the hanger 20), thereby simplifying construction. The hanger 20 can be formed from a metal blank 90, which reduces the number of parts required to hang the joist 12 and simplifies the manufacturing process.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean there are one or more of the elements. The terms "comprising", "including" and "having" are intended to be inclusive and mean there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A hanger for connecting a structural component to a wall including a top plate and studs extending down from the top plate, the wall being adapted to have sheathing mounted thereon, the hanger comprising:

a channel-shaped portion configured to receive the structural component;

an extension portion extending from the channel-shaped portion and configured to extend through the sheathing to engage the wall at a first location; and a connection portion including a top flange extending away from the channel-shaped portion and configured for attachment to the top plate of the wall at a second location spaced from the first location, the connection portion further including a connection flange positioned below the top flange and configured for attachment to one of the studs at a third location spaced from the first location and below the second location, the connection flange arranged with respect to the extension portion to overlie and engage a side portion of said one stud, the connection flange including a fastening structure for use in attaching the connection flange to the side portion of said one stud to transfer a load imposed by the structural component directly to said one stud.

2. The hanger as set forth in claim 1, wherein the connection portion includes at least two connection flanges that are generally parallel with one another and formed as one piece of material with one another.

3. The hanger as set forth in claim 2, wherein the connection flanges are oriented to form a channel for receiving said one stud therein.

4. The hanger as set forth in claim 1, wherein the connection portion includes at least one back flange extending from the extension portion, the back flange configured to overlie and engage a front portion of said one stud, the front portion being orthogonal to the side portion.

5. The hanger as set forth in claim 4, wherein the connection flange is formed as one piece of material with the back flange.

6. The hanger as set forth in claim 5, wherein the connection portion includes a line of perforations configured to facilitate bending of the connection flange in relation to the back flange.

7. The hanger as set forth in claim 4, wherein the back flange includes a fastening structure for use in attaching the hanger to said one stud.

8. The hanger as set forth in claim 7, wherein the fastening structure includes at least one opening for receiving a fastener to fasten the hanger to the vertical member.

9. The hanger as set forth in claim 1, wherein the connection flange comprises a major surface positioned to engage the side portion of said one stud when the hanger connects the structural component to the wall.

10. The hanger as set forth in claim 9, wherein the fastening structure includes at least one opening through the major surface for receiving a fastener to fasten the hanger to the side portion of said one stud.

11. The hanger as set forth in claim 1, wherein the top flange is configured to overlie and engage a top portion of the top plate.

12. The hanger as set forth in claim 11, wherein the top flange includes a fastening structure for use in attaching the hanger to the top plate.

13. The hanger as set forth in claim 1, wherein the extension portion includes extension flanges extending from the channel-shaped portion, each of the extension flanges being configured to extend through the sheathing.

14. The hanger as set forth in claim 1, wherein the channel-shaped portion includes a base sized and shaped for receiving the structural component thereon and side panels extending upward from the base, each of the side panels includes at least one opening for use in attaching the hanger to the structural component.

15. The hanger as set forth in claim 14, wherein the channel-shaped portion further includes back panels, each of the back panels extending from a respective one of the side panels.

16. The hanger as set forth in claim 1, wherein the channel-shaped portion, extension portion, and connection portion are formed as a one-piece construction such that the channel-shaped portion is fixed in position relative to the connection portion.

17. The hanger as set forth in claim 1, wherein the channel-shaped portion, extension portion, and connection portion are formed as one piece of material.

18. The hanger as set forth in claim 1 wherein the connection flange is spaced apart from the top flange.

19. A method of making a hanger for connecting a structural component to a wall including a top plate and studs extending down from the top plate, the wall having sheathing mounted thereon, the method comprising:

providing a sheet of material;

stamping a blank from the sheet of material;

bending the blank to form a hanger comprising a channel-shaped portion configured to receive the structural component;

an extension portion extending from the channel-shaped portion and configured to extend through the sheathing to engage the wall at a first location; and a connection portion including a top flange extending away from the channel-shaped portion and configured for attachment to the top plate of the wall at a second location spaced from the first location, the connection portion further including a connection flange positioned below the top flange and configured for attachment to one of the studs at a third location spaced from the first location and below the second location, the connection flange arranged with respect to the extension portion to overlie and engage a side portion of said one stud, the connection flange including a fastening structure for use in attaching the connection flange to the side portion of said one stud to transfer a load imposed by the structural component directly to said one stud.

20. The hanger as set forth in claim 18 wherein the connection flange is disposed directly under the top flange and lies in a plane intersection the top flange.

* * * * *